United States Patent [19]

Makino

[11] Patent Number: 4,632,276

[45] Date of Patent: Dec. 30, 1986

[54] LIQUID DISPENSING DEVICE

[76] Inventor: Yukio Makino, Kabushikigaisha Towa Japan 29-5, Ikebukuro Honcho 4-chome, Toshima-ku, Tokyo, Japan

[21] Appl. No.: 683,502

[22] Filed: Dec. 19, 1984

[30] Foreign Application Priority Data

Dec. 30, 1983 [JP] Japan ..... 58-200545[U]
Dec. 30, 1983 [JP] Japan ..... 58-200547[U]

[51] Int. Cl.[4] ..... B67B 7/50; B65D 83/14

[52] U.S. Cl. ..... 222/80; 222/5; 222/399

[58] Field of Search ..... 222/5, 373, 399, 83, 222/83.5, 400.7, 509, 518, 80, 82; 441/94, 93; 251/263; 74/107

[56] References Cited

U.S. PATENT DOCUMENTS

| | | | |
|---|---|---|---|
| 2,189,643 | 2/1940 | Ward | 222/399 X |
| 2,347,010 | 4/1944 | Ward | 222/83 X |
| 3,757,371 | 9/1973 | Martin | 441/94 |
| 3,938,704 | 2/1976 | Milgram | 222/5 |
| 4,320,777 | 3/1982 | Tomlin et al. | 74/104 X |

*Primary Examiner*—H. Grant Skaggs
*Assistant Examiner*—Nils E. Pedersen

[57] ABSTRACT

A device for dispensing a liquid comprising a tubular fitting member fitted to a mouth of a vessel storing the liquid, a dispensing pipe mounted to the fitting member, a bomb attachment communicating with the fitting member through a communication passage and holding therein a bomb filled with the liquid, a bomb unstoppering needle fitted with a terminal sealing member therearound and mounted within the bomb attachment so as to be intruded into and receded out of a sealing plate of the bomb held within the bomb attachment, a supporting member for linearly movably supporting the unstoppering needle within the bomb attachment, and a device mounted rotatably in the bomb attachment and adapted for shifting the bomb attachment needle, is disclosed. The acute foremost part of the needle projecting beyond the sealing member pierces through the bomb sealing plate for forming a discharge orifice in the sealing plate for discharging the pressurized fluid from the bomb and thereby dispensing the liquid contained in the vessel. The dispensing device may also be provided with a valving member adapted to open or close a pressurizing fluid vent in timing with the operation of the needle shifting device in such a manner that the pressurizing gas in the vessel is discharged at the same time as the bomb is closed by the needle.

2 Claims, 19 Drawing Figures

LIQUID DISPENSING DEVICE

FIELD OF THE INVENTION

This invention relates to a liquid dispensing device by means of which a liquid such as beer filled and stored in a vessel is dispensed therefrom under the pressure of a pressurizing fluid such as carbonic acid gas.

PRIOR ART

There has been known a device for dispensing a liquid from the vessel wherein a carbonic acid gas is supplied into the vessel and the liquid is caused to be poured out therefrom through a pipe under the pressure of the carbonic acid gas.

The known dispensing device is comprized of a valving unit mounted to the cork of the vessel via a vinyl pipe, and a carbonic acid gas bomb holder attached to the valving unit, which is provided with a gas discharge control knob which in turn may be rotated manually in such a manner that a bomb unstoppering needle formed integrally with said control knob may pierce through a bomb sealing plate for boring a discharge orifice and thereby unstoppering the bomb. The control knob may be rotated manually in reverse for extracting the needle out of the discharge orifice for introducing the carbonic acid gas out of the bomb into the vessel and dispensing the liquid under the pressure of the carbonic acid gas.

In the known dispensing device, the needle tends to wobble because of the absence of a supporting structure for the foremost part of the needle. Thus, when the foremost part of the needle pierces through the sealing plate, the needle tends to wobble under the effect of the piercing resistance and the opening thus formed in the sealing plate tends to be larger in diameter than the foremost part of the needle. With a larger discharge orifice, a larger gap is formed between the orifice and the foremost outer periphery of the needle intruding into the orifice, thus making it difficult to precisely control the amount of the discharged carbonic acid gas.

The known dispensing device is also inconvenient to handle because of the additional disadvantage that the beer tends to drip and be poured out in more than a desired amount under the residual pressure of the carbonic acid gas remaining in the cask even after the supply of the carbonic acid gas into the cask is discontinued by tightening the gas discharge control knob.

OBJECTS OF THE INVENTION

It is an object of the present invention to provide a liquid dispensing device for easily and accurately unstoppering a bomb sealing plate with the aid of an unstoppering needle.

It is also an object of the present invention to provide a liquid dispensing device wherein a discharge orifice conforming in profile to the unstoppering needle can be bored in the bomb sealing plate and the extent of the gap between the foremost outer periphery of the unstoppering needle and the wall of the discharge orifice may be minutely controlled for accurately adjusting the amount of the discharged pressurizing fluid from the bomb.

It is a further object of the invention to provide a dispensing device wherein the bomb unstoppering needle can be fitted into the discharge orifice for readily and positively stopping the orifice for positively preventing leakage of the carbonic acid gas from the inside of the bomb.

It is a further object of the present invention to provide a liquid dispensing device wherein the opening degree of the discharge orifice in the bomb sealing plate may be controlled for precisely adjusting the amount of the discharged gas.

It is another object of the present invention to provide a liquid dispensing device whereby bomb replacement may be considerably facilitated.

These and other objects, features and advantages of the present invention will become more apparent from reading the following detailed description of the preferred embodiments thereof especially in conjunction with the accompanying drawings.

DESCRIPTION OF THE PREFERRED EMBODIMENTS

The liquid dispensing device of the present invention is hereafter explained by referring to the accompanying drawings.

Figure 1:
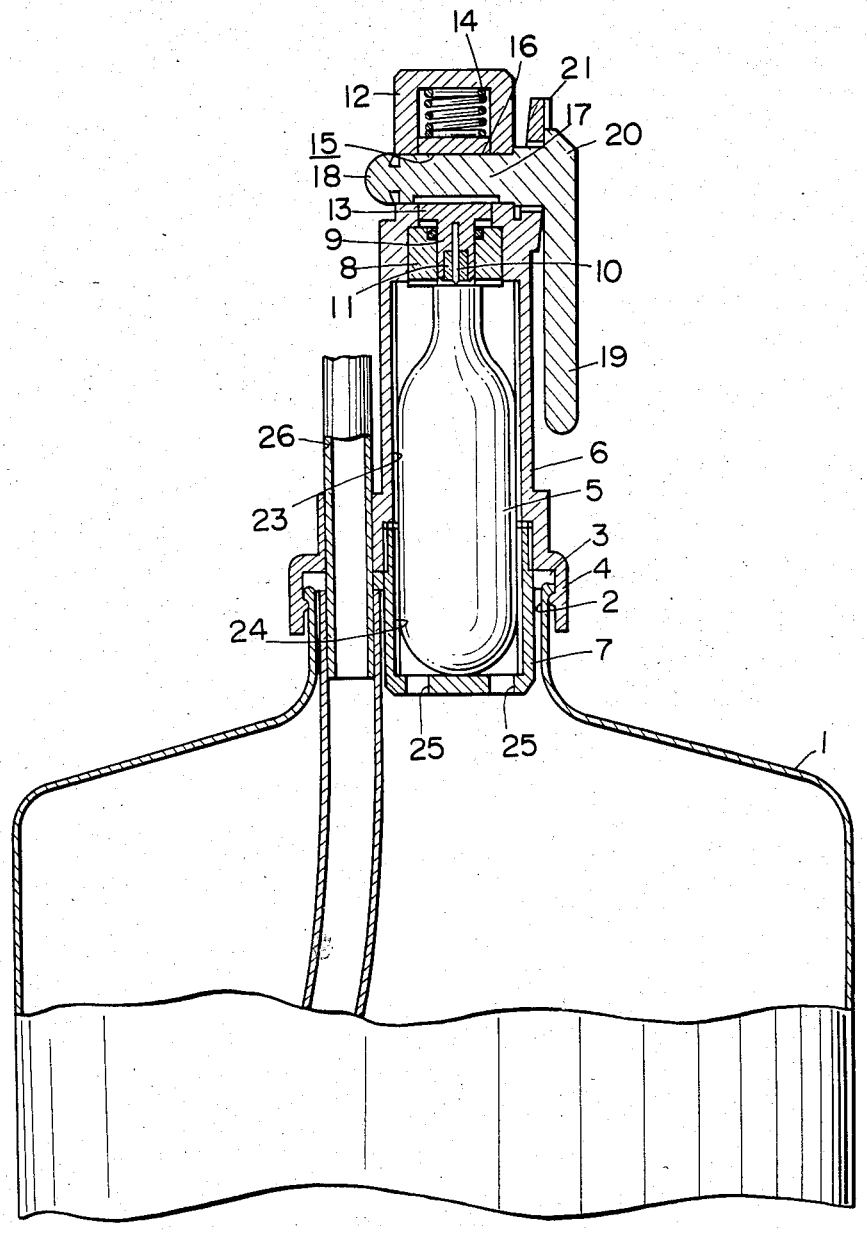
FIG. 1 is a longitudinal sectional view through an embodiment of the liquid dispensing device according to the present invention.

FIG. 1 shows in section the essential parts of the liquid dispensing device of the present invention. The device is so constructed and arranged that the beer stored in a cask 1 may be poured out of the cask 1 upon injecting a carbon dioxide gas into the cask 1.

The liquid dispensing device is formed by a tubular fitting portion 4 attached to the outer periphery of a mouth 2 of the cask 1 by the intermediary of a sealing element 3 and a cylindrical bomb holder 6 formed as one with the fitting portion 4 and holding a small size bomb 5 filled with a liquefied carbon dioxide gas at a pressure of 75 kg/cm$^2$. A lower cap member 7 is threadedly attached to the fitting portion 4 for supporting the bottom of the bomb 5 contained within the holder 6.

A cylinder 8 is secured at the inner periphery of the upper end extremity of the bomb holder 6. The bomb 5 is clamped between the lower cap member 7 and the cylinder 8 so as to be positioned and secured within the holder 6. A stem 9 formed of ABS resin and supporting a bomb unstoppering needle 10 has a close sliding fit in the cylinder 8 for sliding axially of the holder 6. The bomb unstoppering needle 10 provided with an acute foremost part is secured at the center of the stem 9 so that the acute end of the needle projects a small distance from the foremost end face of the stem 9. An annular sealing element 11 of soft rubber such as butadiene or silicon rubber is secured to the foremost part of the stem 9 for encircling the acute end of the needle 10. The foremost end face of the sealing element 11 projects a small distance from the end face of the stem 9 which is smaller than the distance the foremost part of the needle projects from the end face of the sealing member 11.

The rear end of the stem 9 is formed as a block 13 slidable axially of the holder 6 along the inner peripheral surface of an upper cap member 12 which is formed integrally with the holder 6. The block 13 is perpetually urged down in FIG. 1 by a compression coil spring 14 which is disposed between the slide block 13 and the upper wall of the cap member 12.

The slide block 13 has a square through-hole 15 extending at right angles with the axial direction of the cap member 12 and a projection 17 formed with a peripheral camming portion 16 is fitted in the through-hole 15. The one end of the projection 17 is projected out of a through-hole in the cap 12 and formed as an enlarged flange 18 for preventing extrication of the projection 17 from the cap member 12. The other end of the projection 17 is also projected out of the cap 12 via a through-hole in the cap member 12 and formed integrally with a rotary operating lever 19 projecting at right angles with the axial direction of the projection 17.

The bottom end of the operating lever 19 has a projecting portion 20 which is resiliently engaged with a resilient peripheral portion 21 of the holder 6 which is also adapted for guiding the rotation of the operating lever 19.

Figure 2:
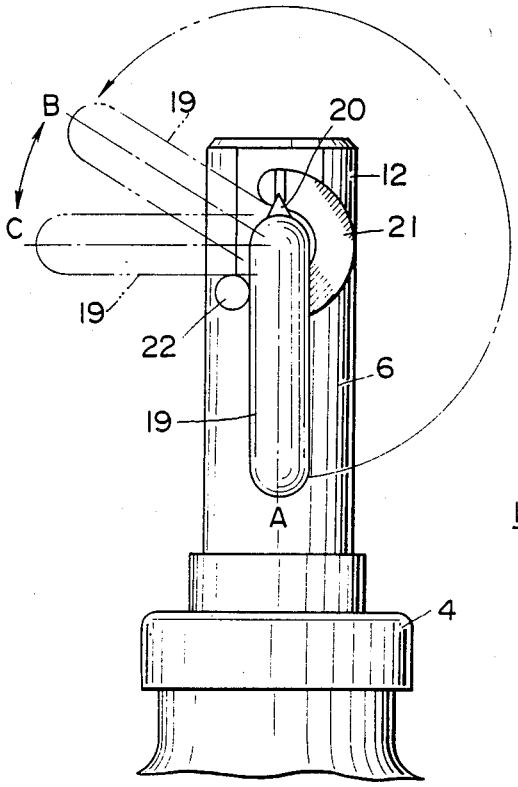
FIG. 2 is a partial side elevation of the device shown in FIG. 1.

The operating lever 19 can be rotated through about 270° with the aid of a stopper projection 22 on the outer periphery of the holder 6 as shown in FIG. 2.

Figure 3:
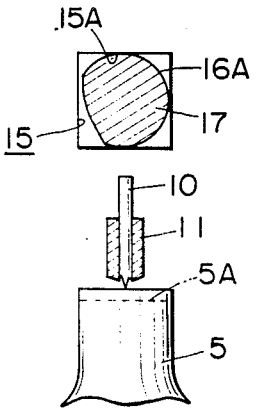
FIG. 3 shows the bomb unstoppering needle and the cam when not in use.
Figure 4:
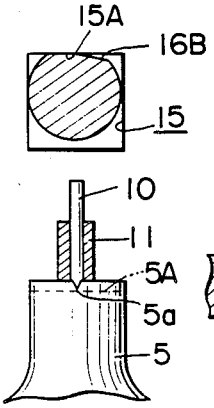
FIG. 4 shows the needle and the cam when a discharge orifice has been bored in the sealing plate.

The device so far shown and described operates as follows:

When the device is not in use, the operating lever 19 is at a point A in FIG. 2. At this time, the first cam surface 16A of the camming portion 16 of the projection 17 is engaged with an upper wall 15A of the through-hole 15 when viewed in FIG. 3, so that the stem 9 is maintained at an elevated position against the force of the compression coil spring 14. Hence, the acute end of the unstoppering needle 10 is spaced above a sealing plate 5A of the bomb 5.

The operating lever 19 is then rotated counterclockwise when viewed in FIG. 2 until the operating lever 19 has been shifted to a point B. At this time, the first cam surface 16A of the camming portion 16 is disengaged from the upper wall 15A of the through-hole 15 and the second cam surface 16B now engages with the upper wall 15A. This causes the stem 9 to be shifted towards the bomb 5 under the force of the compression coil spring 14, the acute end of the needle 10 piercing the central portion of the sealing plate 5A of the bomb 5 and forming a discharge orifice **5*a* in the plate 5**.

Figure 5:
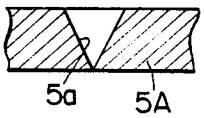
FIG. 5 is an enlarged sectional view showing the discharge orifice.

It should be noted that, since the needle 10 is supported during its downward stroke by the stem 9 the rotation of which about its axis is controlled by the projection 17, the acute end of the needle 10 travels along a straight path without wobbling until it pierces through the sealing plate 5A. Hence, the discharge opening **5*a* has the sectional shape of an inverted triangle corresponding to the shape of the acute end of the needle 10, as shown in FIG. 5, with the outer periphery of the needle 10 intimately contacting with the wall of the orifice 5*a***.

When the opening **5*a* is formed in the sealing plate 5A, the sealing plate 11 is pressured tightly against the sealing plate 5A and deformed resiliently for positively sealing the orifice bored 5*a*** in the sealing plate.

As the operating lever 19 is rotated counterclockwise from the point B in FIG. 2, the second cam surface 16B of the camming portion 16 starts to be shifted away from the upper wall 15A of the through-hole 15 for elevating the stem 5 (FIG. 2). This causes the sealing member 11 to be released from pressuring contact with and be shifted away from the sealing plate 5A so that the carbon dioxide gas contained in the bomb 5 is discharged from the orifice **5*a* into the holder 6**.

The gas discharged into the holder 6 is supplied into the cask 1 by way of flutes 23, 24 formed on the inner peripheral surface of the holder 6 and on the inner peripheral surface of the lower cap 7, respectively, and gas supply ports 25 formed in the bottom surface of the lower cap member 7. The beer contained in the cask 1 is poured out through a discharge pipe 26 under the pressure of the carbonic acid gas.

Figure 6:
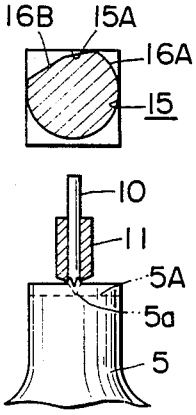
FIG. 6 shows the needle and the cam when the discharge orifice has been exposed.

When the lever 19 is at a point C in FIG. 2, the stem 9 is supported with the acute end of the needle 10 substantially disengaging from the orifice **5*a* and the orifice 5*a* exposed fully as shown in FIG. 6**.

The operating lever 19 can be rotated between the points B and C in FIG. 2 for adjusting the intrusion of the acute end of the needle 10 into the orifice **5*a*and thereby adjusting the discharge quantity of the carbonic acid gas. Since the discharge opening 5*a* is a small through-hole conforming in profile to the foremost part of the needle 10, it is possible to effect minute adjustment of the extent of the gap between the foremost outer periphery of the needle 10 and the wall of the orifice 5*a*** and hence the amount of discharged carbonic acid gas.

Figure 7:
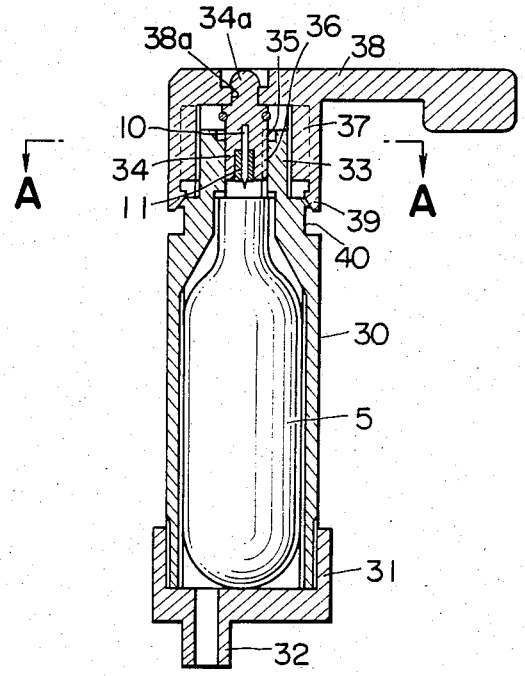
FIG. 7 is a longitudinal section through the dispensing device according to a modification.

The liquid dispensing device according to a modified embodiment of the present invention is shown in FIG. 7. The dispensing device of the present modification has a cylindrical holder 30 holding a bomb 5 and a lower or first cap member 31 is threadedly attached to one end of the holder 30, as in the preceding embodiment mentioned above. The cap member 31 has a tubular portion 32 that may be in communication with the interior of the holder 5. The tubular portion 32 is adapted to be fitted to the mouth 2 of the cask 1.

The other end of the holder 30 is formed as a cylinder 33 in which a stem 34 is fitted for slidably axially of the holder 30. A bomb unstoppering needle 10 having an acute piercing end is securely mounted at the center of the stem 34, and an annular sealing member 11 of soft rubber such as butadiene rubber or silicon rubber is securely attached to the outer periphery of the needle 10. The sealing member 11 projects beyond the foremost end face of the stem 34 but the foremost acute end of the needle 10 projects further beyond the foremost end face of the sealing member 11.

Figure 8:
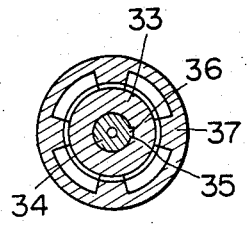
FIG. 8 is a section taken along line A—A of FIG. 7.

The outer periphery of the stem 34 is formed with a rib 36 for engaging with a mating flute 35 formed in the cylinder 33 for inhibiting rotation of the stem 34 about its axis, as also shown in FIG. 8.

The stem 34 is rotatably mounted to a second or upper cap member 37 threadedly rotatably mounted to an upper peripheral part of the holder 30 with an engaging integral projection 34 of the stem 34 engaging with a mating through-hole, not shown, in the cap 37.

The above described liquid dispensing device operates in such a manner that the second cap member 37 is screwed down by rotation of a rotary operating lever 38 provided to the second cap member 37 for lowering the stem 34 in FIG. 7 with the foremost acute end of the unstoppering pin 10 piercing the sealing plate 5A of the bomb 5 and boring the orifice **5*a* in the sealing plate 5, as in the preceding embodiment of the invention mentioned above. It should be noted that, when the orifice 5*a* is bored in the sealing plate 5A, an inturned flange 39 formed at the open edge of the second cap 37 is caused to descend into and be engaged with an annular recess 40 formed on the upper outer periphery of the holder 30**.

It should be noted that the needle 10 is supported during its downward stroke by the stem 34 which is regulated with respect to the rotation thereof about its axis, in such a manner that the foremost acute end of the needle 10 is moved along a straight line without wobbling for piercing through the sealing plate 5A. The result is that the orifice 5A has the sectional shape of an inverted triangle conforming in configuration to the sectional configuration of the foremost acute end of the needle 10 as in the preceding embodiment mentioned above with the foremost outer periphery of the needle 10 tightly engaging with the wall of the orifice **5*a***.

When the orifice **5*a* has been bored in the plate 5A, the sealing member 11 is tightly pressured against the sealing plate 5A with elastic deformation of the sealing member 11 thus readily and positively stopping the orifice 5*a* formed in the sealing plate 5A**.

When the cap 37 is slacked, the stem 34 is elevated for opening the orifice **5*a*. The carbonic acid gas discharged through the orifice 5*a* is supplied into the cask 1 through the holder 30 and the tubular portion 32**.

The cap 37 can be turned in preset directions for adjusting intrusion into the orifice **5*a* of the acute end of the needle 10 and hence the discharged amount of the carbonic acid gas. Since the discharge orifice 5*a* is a small through-hole conforming in profile to the foremost part of the needle 10, it is possible to effect minute adjustment of the extent of the gap between the foremost outer periphery of the needle 10 and the wall of the orifice 5*a*** and hence the amount of discharged carbonic acid gas.

Figure 9:
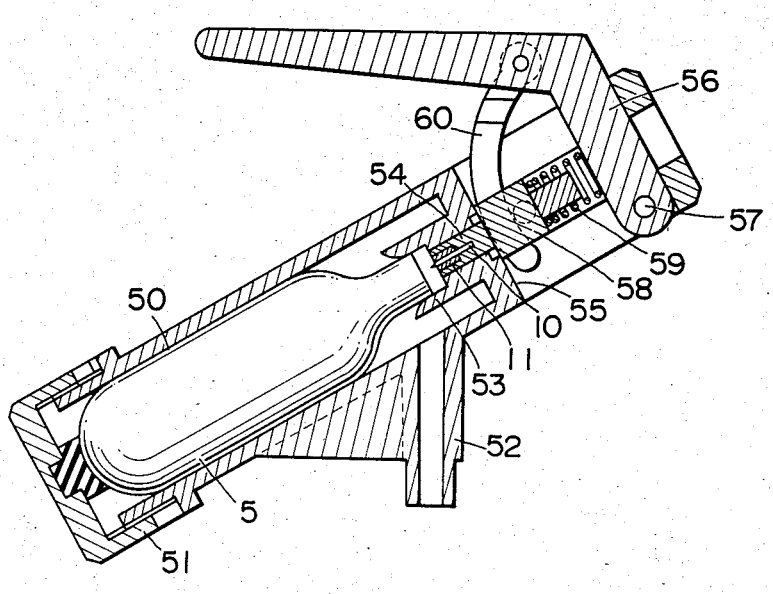
FIG. 9 is a longitudinal section through the dispensing device according to a further modification.
Figure 10:
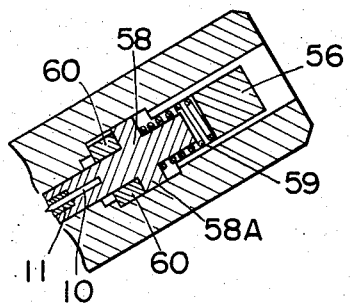
FIG. 10 is a sectional view showing the engaging state of the operating block with the link.

The liquid dispensing device according to a further modification of the present invention is shown in FIG. 9. The dispensing device has a cylindrical holder 50 for a bomb 5 filled with a liquefied carbonic acid gas. To one end of the holder 50 is rotatably threadedly mounted a lower cap member 51 for supporting the bottom end of the bomb 5. A tubular extension 52 is formed integrally with the outer peripheral portion of the holder 50 adapted for communicating with the inside of the holder 50 and being fitted in the interior of the cask 1. A cylindrical extension 53 is formed within the holder 50 for fitting of the end portion of the bomb 5. Within the cylinder 53, there is closely and slidably fitted a stem 54 for sliding axially of the holder 50. Within the center of the stem 54, there is securely mounted a bomb unstoppering needle 10 the foremost outer periphery of which is fitted an annular sealing member 11 of soft rubber such as butadiene rubber or silicon rubber as in the preceding embodiments of the invention described above. The sealing member 11 is projected beyond the end face of the stem 54 with the foremost part of the needle 10 projecting further beyond the end face of the sealing member 11.

The upper part of the holder 50 has a throughhole 55 extending at right angles with the axis of the holder 50. A rotary actuating lever 56 has its one end pivotally mounted within the through-hole 55 by a projection 57 for actuating the needle 10. The other end of the lever 56 is projected out through the throughhole 55 and bent in the direction of the holder 50.

The bottom end of the stem 54 is formed with a sliding block 58 projecting into the through-hole 55. A compression coil spring 59 is installed between the block 58 and the actuating lever 56 for perpetually resiliently urging the stem 54 towards the bomb 5 through the medium of the block 58.

A pair of arcuate rotary arms 60, 60 are pivotally mounted at one ends thereof to the actuating lever 56 for engaging with a flange 58A of the operating block 58 for elevating the stem 54 against the force of the compression coil spring 59.

Figure 11:
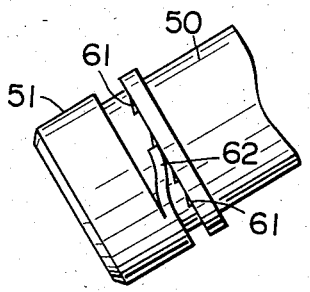
FIG. 11 is a partial side elevation of the cap member.

With the dispensing device of the present embodiment, the cap member 51 is screwed for pressing the bomb 5 towards the unstoppering needle 10, which then pierces through the sealing plate 5A of the bomb 5 for forming the discharge orifice **5*a* in the sealing plate 5A. The open edge of the cap 51 is formed with a resilient engaging portion 62 for engaging with a plurality of ratchet teeth 61 of the holder 50 as shown in FIG. 11 for preventing inadvertent reversal and loosening of the cap 51**.

It should be noted that the needle 10 is supported by the stem 54 the rotation of which about its axis is regulated by the rotary arms 60, 60, so that the foremost part of the needle 10 may be supported fixedly without wobbling. Hence the discharge orifice **5*a* has the cross-sectional shape of an inverted triangle conforming in profile to the foremost part of the needle 10, and the foremost outer periphery of the needle 10 is intimately contacted with the wall of the discharge orifice 5*a***.

When the orifice **5*a* has been bored in the plate 5A, the sealing member 11 is tightly pressured against the sealing plate 5A with elastic deformation of the sealing member 11. Thus the discharge orifice 5*a* can be easily and positively stopped after the orifice 5*a* is bored and the orifice 5*a* can be closed positively by fitting the needle 10 in the orifice 5*a***.

Upon rotation of the actuating lever 56 counterclockwise in FIG. 9, the stem 54 is elevated for opening the orifice **5*a*. The carbonic acid gas discharged through the orifice 5*a* may be supplied into the cask 1 through a gap between the cylinder 53 and the bomb 5, through the inside of the holder 50 and the tubular extension 52**.

The extent of rotation of the actuating lever 56 can be adjusted variably for adjusting intrusion into the orifice 5*a* of the foremost part of the needle 10 and hence the discharged amount of the carbonic acid gas. Since the discharge orifice 5*a* is a small through-hole conforming in profile to the foremost part of the needle 10, it is possible to perform minute adjustment of the extent of the gap between the foremost outer periphery of the needle 10 and the wall of the orifice 5*a* and hence the amount of the discharged carbonic acid gas.

Figure 12:
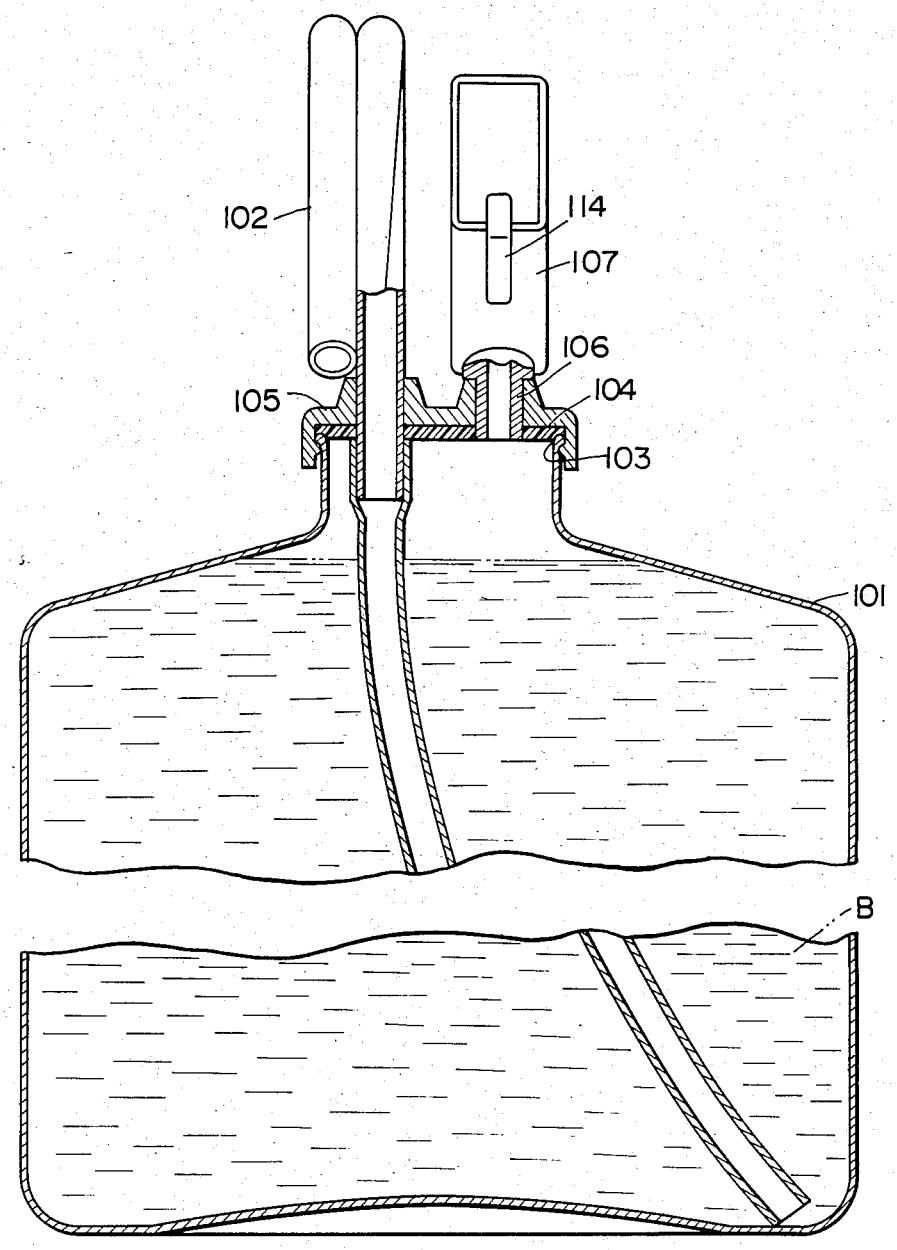
FIG. 12 is a side elevation showing the dispensing device according to a further modification, with part being broken away.
Figure 13:
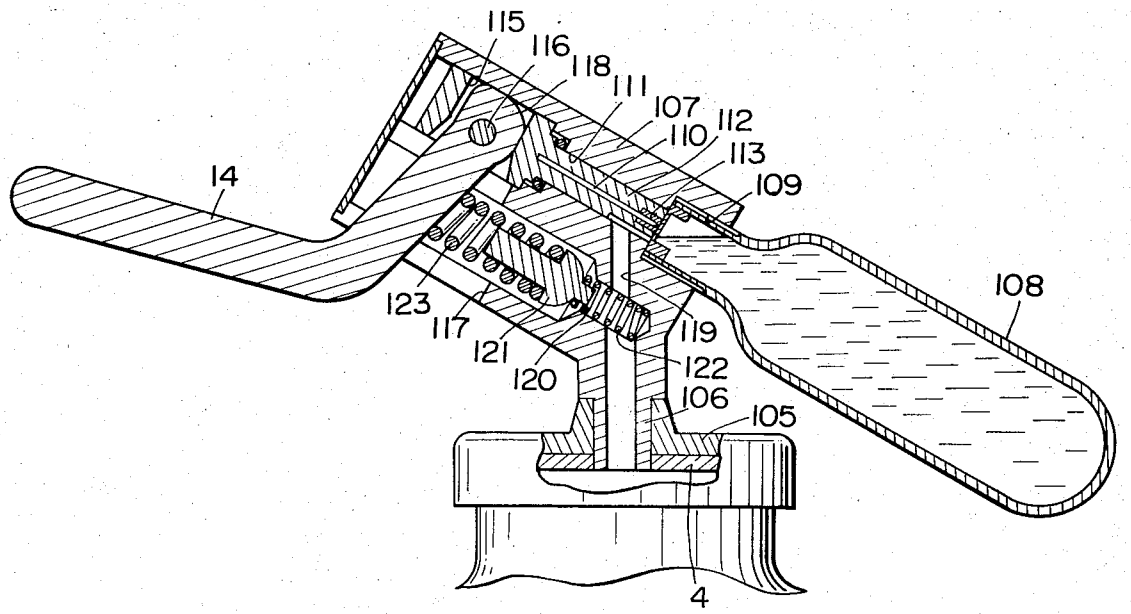
FIG. 13 is a longitudinal section through essential portions of the dispensing device shown in FIG. 12.

FIG. 12 is a side elevation showing a further modification of the liquid dispensing device of the present invention when applied to a domestic table beer cask, with a portion being broken away, and FIG. 13 is an enlarged sectional view showing only essential parts of the device. In the present modification, a carbonic acid gas is injected into the beer cask 101 for pouring out the beer B stored in the cask by way of a vinyl pipe 102. The dispensing device has a bomb attachment 107 comprized of a tubular section 106 fitted to a cap member 105 mounted in turn to a mouth 103 of the cask 101 by the medium of a packing member 104. The bomb attachment 107 is formed of synthetic resin for weight saving and a bomb mounting opening 109 is formed at one end of the bomb attachment 107 for removably mounting a small-sized bomb 108 charged with a liquefied carbonic acid gas at a pressure of 75 kg/cm$^2$. The opening 109 is a male threaded hole for meshing with the female threaded foremost part of the bomb 108. The bomb can be supported with a downward slant with respect to the bomb attachment 107 by screwing the foremost part of the bomb 108 into the mounting opening 109.

The bomb attachment 107 has a bomb unstoppering needle 101 the acute end of which may be intruded into or receded away from the opening 109. The needle 110 is secured to a stem 112 which is slidably and intimately fitted within a cylindrical opening 111 bored in the bomb attachment 107 coaxially with the mounting opening 111. The foremost part of the stem 112 is fitted with an annular sealing member 113 of soft rubber, such as butyl rubber, said sealing member 113 intimately surrounding the foremost part of the needle 110.

An L-shaped rotary operating lever 114 for actuating the needle 110 is provided at the rear side of the stem 112 and has its one end pivotally mounted via a projection 116 in a diametral lever mounting through-hole 115 bored at the rear side of the stem 112 and its other end projecting out through a window opening 117 formed in the bomb attachment 107. The one end of the lever 114 is formed as a camming portion 118. In the pre-unstoppering state of the pouring out device with the actuating lever 114 remaining in the first position, the stem 112 is maintained in such a position that the foremost part of the unstoppering needle 110 is projected into the mounting opening 109. When the lever 114 is rotated counterclockwise in FIG. 13 about a projection 116 to a second position, the cam 118 is engaged with the rear wall of the lever-mounting through-hole 115 for sliding the stem 112 towards the rear. This causes the foremost part of the stem 110 to be projected out of the mounting opening 109.

In the bomb attachment 107, there is formed a gas communication passage 119 adapted for providing communication between the opening 109 and the inside of the tubular section 106 through a cylinder 111. A gas vent opening 120 is formed halfway in the gas communication passage 119, and a valving member 121 formed e.g. of rubber and adapted for opening and closing the gas vent opening 120 is provided in the vicinity of the vent opening 120. The valving member 121 is perpetually urged by a first compression coil spring 122 mounted across the communication passage 119 in a direction for exposing the gas vent opening 120. The valving member 121 is operatively associated with the actuating lever 114 by the medium of a second compression coil spring 123. It should be noted that the spring force of the first compression coil spring 122 is selected to be lower than that of the second compression coil spring 123, and the springs 122, 123 also perform the function of automatically returning the actuating lever 114.

When the rotary operating lever 114 is in the first or inoperative position, the valving member 121 is maintained by the first compression coil spring 122 at a position for exposing the air vent opening 120. When the lever 114 is turned counterclockwise in FIG. 13 about the projection 116 to its second position, the valving member 121 is maintained by the second compression coil spring 123 at a position for closing the gas vent opening 120.

Figure 14:
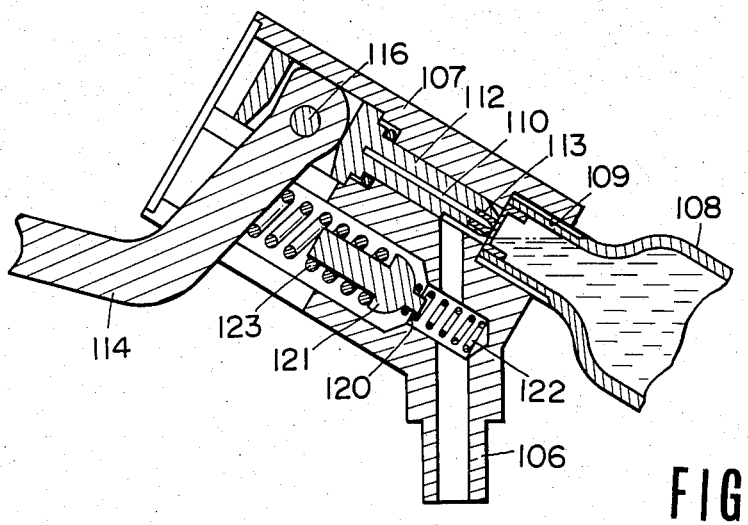
FIG. 14 is a sectional view showing the essential parts of FIG. 12 and showing the bomb in the unstoppered state.
Figure 15:
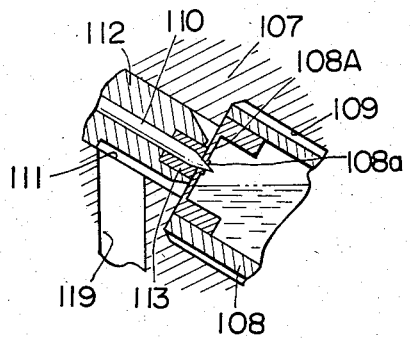
FIG. 15 is an enlarged sectional view showing the bomb mounting opening and the neighboring portions.

The liquid dispensing device operates as follows:

The bomb 108 is attached in the mounting opening 109 of the bomb attachment 107 as shown in FIG. 14. With the bomb thus mounted in position, the foremost acute part of the needle 110 pierces through the sealing plate 108A of the bomb 108, as also shown in FIG. 15, for boring a small discharge orifice 108*a* in the sealing plate 108A. At this time, the sealing member 113 is pressured against the sealing plate 108A for completely closing the orifice 108A for preventing the carbonic acid gas from being discharged through the orifice 108*a*. Hence, the carbonic acid gas is not supplied into the cask 101.

When the lever 114 is turned towards the cask 101 (counterclockwise in FIG. 16), the gas vent opening 120 is closed by the valving member 121. As the lever 114 is turned further as shown in FIG. 17, the stem 112 is slid towards rear for withdrawing the foremost part of the unstoppering needle 110 out of the sealing plate 108A. At this time, the sealing plate 113 is moved away from the sealing plate 108A as also shown in FIG. 18 so that the carbonic acid gas contained in the bomb 108 is supplied into the cask 101 through the cylinder 111, gas communication passage 119 and the tubular section 106, as indicated by the arrow marks in FIGS. 17 and 18.

As the carbonic acid gas is supplied into the cask 101, the beer B contained in the cask 101 is poured out through the vinyl pipe 102 under the pressure of the carbonic acid gas.

Figure 19:
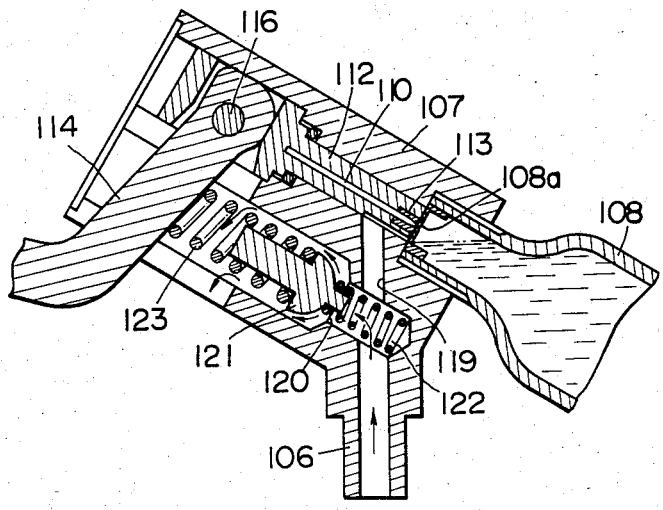
FIG. 19 is a sectional view similar to FIG. 14 and showing the state in which the beer dispensing is terminated.

When the levelling down force of the rotary operating lever 114 is released as shown in FIG. 19, the lever 114 is urged clockwise in FIG. 19 under the force of the first and second coil springs 122, 123. This causes the stem 112 to slide forwards and the sealing member 113 to be again pressured against the sealing plate 108A, the needle 110 completely closing the discharge orifice 108*a* and the valving member 121 exposing the gas vent opening 120. With the valving member 121 thus exposing the gas vent opening 120, the carbonic acid gas remaining in the cask 101 is discharged to atmosphere through the tubular section 106, gas communication passage 119 and the gas vent opening 120.

Figure 16:
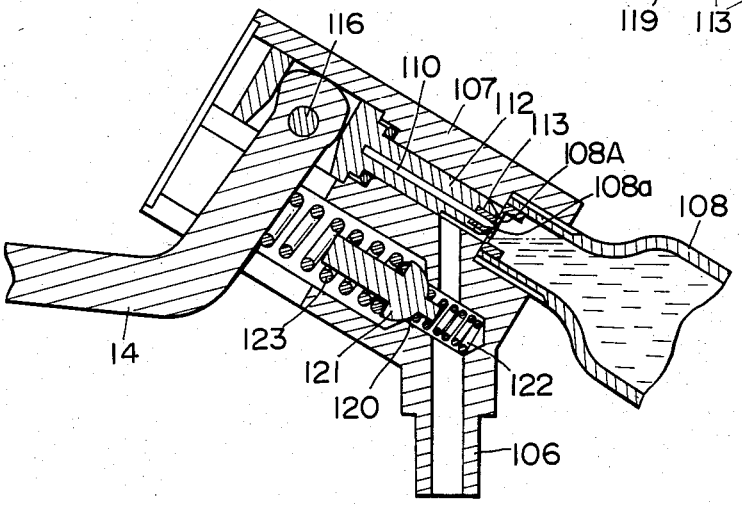
FIG. 16 is a sectional view similar to FIG. 14 and showing the valving member stopping the vent opening.
Figure 17:
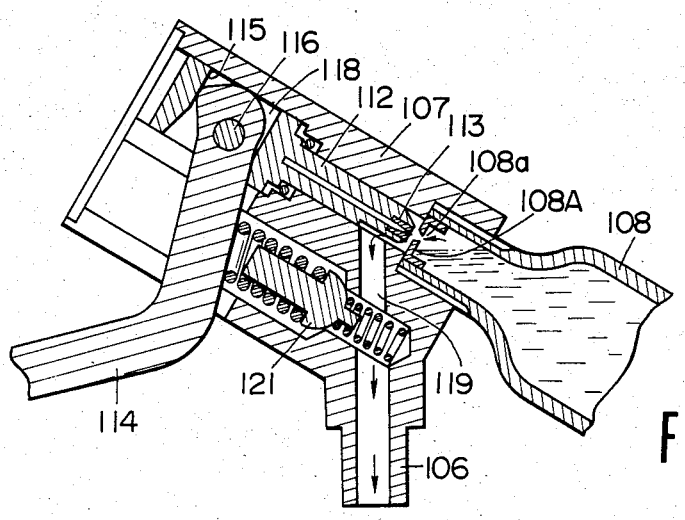
FIG. 17 is a sectional view similar to FIG. 14 and showing the carbonic acid gas in the bomb having been discharged.
Figure 18:
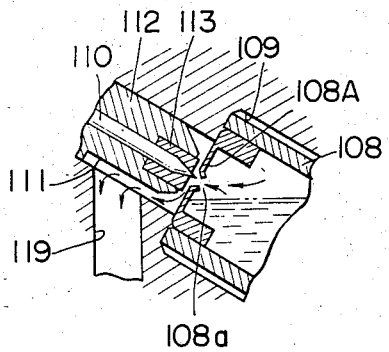
FIG. 18 is an enlarged sectional view similar to FIG. 15 and showing the bomb mounting opening of FIG. 17 and the neighboring portions.

It should be noted that the discharged amount of the carbonic acid gas through the discharge opening 108*a* and hence the dispensed amount of the beer B can be easily adjusted by controlling the levelling down state of the actuating lever 114 to be within the range between the position shown in FIG. 16 and that shown in FIG. 17 for controlling the extent of intrusion of the needle 110 into the discharge orifice 108*a*.

According to the present embodiment, when the supply of the carbonic acid gas into the cask 101 is terminated (i.e. by releasing the actuating lever 114), the carbonic acid gas remaining in the cask 101 is discharged to atmosphere for lowering the pressure in the cask 101 and momentarily stopping dispensing the beer B. In this manner, the beer B can be poured out in a precisely desired amount without the risk of dripping.

Also, the valving member 121 is adapted for closing the gas vent opening 120 under the force of the second compression coil spring 123, the valving member 121 is able to immediately expose the gas vent opening 120 under a shock applied to the cask 101 from the outside, thus immediately stopping pouring out of the beer B. Thus, even in instances where the exit end of the vinyl pipe 102 is shifted by the shock from its intended position, there is no risk of the beer B leaking through the pipe 102 and spilling over the table.

Moreover, since the specific gravity of the carbonic acid gas is about 1.5 times that of air, once the gas is filled in the cask 101, an amount of the gas affording a pressure equivalent to the atmospheric pressure is left in the cask 101 even after the carbonic acid gas is discharged to atmosphere. Thus the beer B in the cask 101 does not tend to become vapid.

In addition, pouring out of the beer B can be easily initiated by simply levelling the actuating lever 114 towards the cask 101 and discontinued by simply releasing the manual pressure applied to the lever 114.

Moreover, the bomb 108 is mounted to the bomb attachment by a simple screw connection and hence can be replaced by a simplified operation.

What is claimed is:

1. A liquid dispensing device of the type in which the liquid is dispensed under the force of a liquefied pressurized gas comprising:

a cask holding a liquid to be dispensed;

a tubular bomb holder in the form of a cylindrical upper cap having a bottom and fitted about a mouth of the cask and adapted for performing a longitudinal movement relative to said cask;

a lower cap member fitted to a lower open end of said holder and holding a bomb in tight lateral and vertical engagement therewith and in cooperation with said bomb holder;

a hollow cylinder securely fitted to an inner peripheral end of said bomb holder at a distance from the bottom of said holder;

a block slidably received within a cylindrical blind bore of said bomb holder at a position above said cylinder;

a transverse through-hole in said slidable block and said holder;

an operating angle lever having a horizontal projecting portion and a depending portion, said horizontal projecting portion being fitted in said through-hole in said block and acting as a cam adapted for cooperating with the sides of said through-hole which latter acts as a cam follower;

said slide block having a lower extension in the form of a stem slidably received in said hollow cylinder and carrying a stationary needle surrounded by a stationary sealing member both fixed relative to said stem, said needle and the sealing member being disposed at the lower end of said slide block such that, in a bomb stoppering position of said angle lever, the lower end face of the seal projects a small distance from the end face of the stem and the tip of the needle projects a small distance from the lower end face of said seal;

means for resiliently urging said slide block downwards;

through-apertures in said lower cap member for communicating the interior of said bomb holder with the interior of the cask;

fluted passage means on an inner surface of said holder and on the outer surface of said bomb; and dispensing hose means for dispensing the liquid out of said cask;

said needle being movable along with said seal therearound with movement of said slide block brought about by the camming action of said horizontal projecting portion of said operating lever on the through-hole in the slide block without wobbling by virtue of a sliding fit of said stem within said cylinder and tight lateral and vertical engagement of said bomb with said bomb holder;

said horizontal projecting portion having a cam profile such that, in a first position of the depending portion of the operating lever, corresponding to said bomb stoppering position, said needle lies above a top cover of said bomb, in a second position thereof, the needle just completes forming a profiled discharge orifice in the top cover of the bomb, the sealing member then tightly sealing the orifice thus formed in the bomb cover, and, in a third position thereof intermediate between said first and second positions, said needle and the sealing member are disposed slightly above the bomb cover to permit discharge of pressurized gas from said bomb through said fluted passage means and said through-apertures to thereby discharge the liquid through said dispensing hose means out of said cask.

2. A device according to claim 1 wherein said operating angle lever is minutely moved between said second position and said third position for minute adjustment of the flow of said pressurized gas and hence that of the liquid against the force of said resilient means.

* * * * *